United States Patent [19]

Sato

[11] 4,058,051

[45] Nov. 15, 1977

[54] PORTABLE TAGGING MACHINE

[75] Inventor: Yo Sato, Tokyo, Japan

[73] Assignee: Kabushiki Kaisha Sato Kenkyusho, Tokyo, Japan

[21] Appl. No.: 673,380

[22] Filed: Apr. 5, 1976

[30] Foreign Application Priority Data

Apr. 7, 1975 Japan ..... 50-41244

[51] Int. Cl.[2] ..... B31B 1/90

[52] U.S. Cl. ..... 93/88

[58] Field of Search ..... 93/87, 88; 227/129

[56] References Cited

U.S. PATENT DOCUMENTS

| | | | |
|---|---|---|---|
| 2,503,903 | 4/1950 | Cunningham et al. | 93/88 UX |
| 2,748,676 | 6/1956 | Braun | 93/88 |
| 3,861,280 | 1/1975 | Sato | 93/88 |

*Primary Examiner*—Roy Lake
*Assistant Examiner*—E. F. Desmond
*Attorney, Agent, or Firm*—Ostrolenk Faber Gerb & Soffen

[57] ABSTRACT

A portable tagging machine, in which a continuous strip of separable tags is indexed by a feed mechanism that is actuated simply by the manual operation of a lever mechanism. Each time the lever mechanism is manually operated, the leading tag of the strip is printed by a printing head, separated from the rest of the strip by a cutter, and stapled by a stapling mechanism to an article of clothing which is inserted into a slot formed in the machine casing. These printing, cutting and stapling mechanisms are all actuated by the manual operation of the lever mechanism. The tagging machine has a return mechanism which is operative to force the stapling mechanism out of contact with the article being tagged so as to remove any obstacle from the advance of the tag strip simultaneously as the stapling operation is finished. There is a positioning mechanism which is operative to firmly hold the strip in position while it is released from engagement with the feed mechanism.

43 Claims, 16 Drawing Figures

PORTABLE TAGGING MACHINE

BACKGROUND OF THE INVENTION

1. Field of the Invention

The present invention relates to a tagging machine, and particularly to a portable tagging machine which can be operated by one hand for successively fastening or stapling printed price tags, or the like, to commodities such as articles of clothing.

2. Description of the Prior Art

Price or other information has been conventionally applied to commodities by a portable labeling machine (or a hand operated labeler), which uses labels that are applied on a continuous strip of backing paper. Since the back faces of these labels are coated with an adhesive, their major application is in the indication of prices upon foodstuffs or articles of daily use, and their major use is in supermarkets, or the like. However, these labels cannot be used on commodities that may react chemically with the adhesive and, for example, become discolored or on commodities that may be soiled with dust, or the like that often sticks to the adhesive left on the garments after removal of the labels.

Conventional tagging methods for articles of clothing comprise using price tags which have no adhesive applied to their back faces. One common tagging method uses hand-sewn tags that are manually attached one by one to the articles. Another tagging method uses a special hand operated device to fasten the tags one by one to the articles by means of expensive plastic filaments. A third method employs a stationary, power operated tagging machine to pin the tags to the articles. One disadvantage of those conventional methods is that the printing of individual tags and the fastening of the tags to the articles to be tagged are carried out independently and manually and thus with reduced efficiency. For the power operated stationary tagging machine, another disadvantage is that the printing and fastening operations require that the articles to be tagged be brought to the place where the machine is installed.

The conventional tagging methods are not as satisfactory as a tagging method using a portable labeling machine, which can be operated by one hand of an operator. Such machines are in use in food stores. While holding a foodstuff, or the like, with one of his hands, the operator can accomplish both the printing of the labels and their attachment to the foodstuff, and this can be done either at a counter where commodities are displayed or anywhere else.

Thus, the invention relates to a portable tagging machine which can attach printed tags to articles of clothing or other staple receiving commodities by means of staples. This portable tagging machine includes a printing mechanism, a tag feed mechanism, a tag stapling mechanism and a grip and hand lever combination for operating all of the foregoing, all of which are mounted in a machine casing. The printing and tagging operations can be carried out by means of the grip and the hand lever of the machine being simply gripped and released by one hand of an operator. Thus, the two operations of printing and tagging can be performed by means of a single action at any place, such as a clothing counter where articles of clothing are displayed.

After actual use, however, I have found several points to be improved. First, the machine casing becomes clogged with the tags. Even after a tag is fastened to an article of clothing, the staple enclosure of the stapling mechanism may not descend promptly. Thus, the rest of the continuous strip of tags will have started its advance although the tagged article and the remaining tags are still pinched between the leading end of the staple enclosure and the staple bending or clinching member.

A second point needing improvement is the undesirable untimely shifting of the continuous tag strip because there is no mechanism which can reliably hold the tag strip in position. As a result, the tag strip cannot be fed correctly. It may even be retracted by the feed pawl as the pawl is being carried back. Likewise, when a tagged article is being taken out of the tagging machine, the trailing tag strip may be pulled out by the tagged article. This is often experienced when the tag has its rear edge incompletely separated from the leading edge of the trailing tag strip.

A third point needing improvement results from the undesirable, unpredictable shifting of the continuous tag strip. This shifting may even occur during the printing operation, whereby it is often impossible to obtain desirably clear printing.

SUMMARY OF THE INVENTION

It is, therefore, a major object of the present invention to provide a portable tagging machine having none of the above drawbacks.

A further object of the invention is to provide a portable tagging machine which can both print and apply a tag in a single manual operation.

Another object of the invention is to provide a portable tagging machine which avoids obstruction by the stapling mechanism of the advance of the trailing tag strip, thereby to ensure reliable and smooth feed of the tag strip.

Still another object of the invention is to provide a portable tagging machine equipped with a positioning mechanism, which can reliably hold the continuous tag strip in position so that the tag strip may be correctly fed, so that the tag strip may be prevented from unnecessary movement while the feed pawl is being carried back, and so that, even if the foremost tag of the strip that has been stapled to an article should not be cut off completely, the rest of the tag strip will not be pulled out together with the stapled tag.

A further object of the invention is to provide a portable tagging machine, which firmly positions the continuous tag strip even during the printing operation so that the tag strip may not shift, thereby to make it possible to print the tag clearly with a desired inscription.

A still further object of the invention is to provide a portable tagging machine having such a size and weight that it can be carried anywhere in a store in one hand of an operator, so that a new tag printed, for instance, with a new price, may be fastened to an article at any counter in the store.

According to the present invention, a portable tagging machine includes a casing having a pair of side plates that are joined together to form a slot at their front portions, into which an article to be tagged is inserted. The rear portions of the side plates are formed into a grip and the grip defines a passageway through which a continuous strip of tags extends. Within the casing are mounted lever means, comprising a pair of actuating levers extending rearward of the casing to form a hand operated lever. The hand lever is normally biased to a first release position, at which it is angularly spaced from the grip. When it is manually gripped, the hand lever is rotated to a second position at which it approaches the grip.

The continuous strip of tags is indexed along guide means in the casing by feed means which is actuated by the rotation of the lever means between its first and second positions. The feed means includes pawl means which is moved back and forth along the length of the strip. The pawl means engages the tag strip during its forward travel and releases from the engagement with the tag strip during its backward travel. Linking means is connected between the lever means and the pawl means so as to convert the rotation of the hand lever into the forward and backward motion of the pawl means.

For printing a desired inscription on the foremost tag of the continuous tag strip, printing means is carried on the linking means so as to simultaneously move therewith into and out of contact with the foremost tag. Printing is accomplished when the hand lever is gripped to be rotated to the second position. The now printed tag is separated from the rest of the tag strip by cutting means which is also carried on the linking means.

Simultaneously with the motion of the lever means, yhe cutting means is brought into and out of a slit which is formed at the rear edge of the foremost tag, thereby to separate the foremost tag when the hand lever is gripped to rotate it to the second position.

Stapling means is provided for stapling the printed and separated tag to an article inserted into the article receiving slot. The stapling means is normally biased to its return position, where it is away from the article and the foremost tag. The stapling means is actuated by the lever means to rotate into contact with the article, whereby the stapling occurs when the hand lever is gripped to rotate it to the second position.

Thus, by simply gripping and releasing the hand lever, each foremost tag is printed with any desired inscription, separated from the continuous tag strip, and stapled to the article.

Pressure return means is incorporated into the portable tagging machine for forcing the stapling means out of contact with the tagged article. This removes any obstacle from the advancing continuous tag strip. This return means is actuated by the lever means to return the stapling means from the stapling position to the return position as the hand lever returns to the first position.

Strip positioning means firmly holds the tag strip in position while it is being released from engagement with the pawl means of the feed means. This positioning means is also actuated by the lever means through the pressure return means to be brought into and out of engagement with a slit which is formed between two adjacent tags in the rest of the continuous tag strip.

Other objects and advantages of the present invention will be apparent from the following description taken in conjunction with the accompanying drawings, in which like reference numerals designate like parts.

DETAILED DESCRIPTION OF A PREFERRED EMBODIMENT

Figure 1:
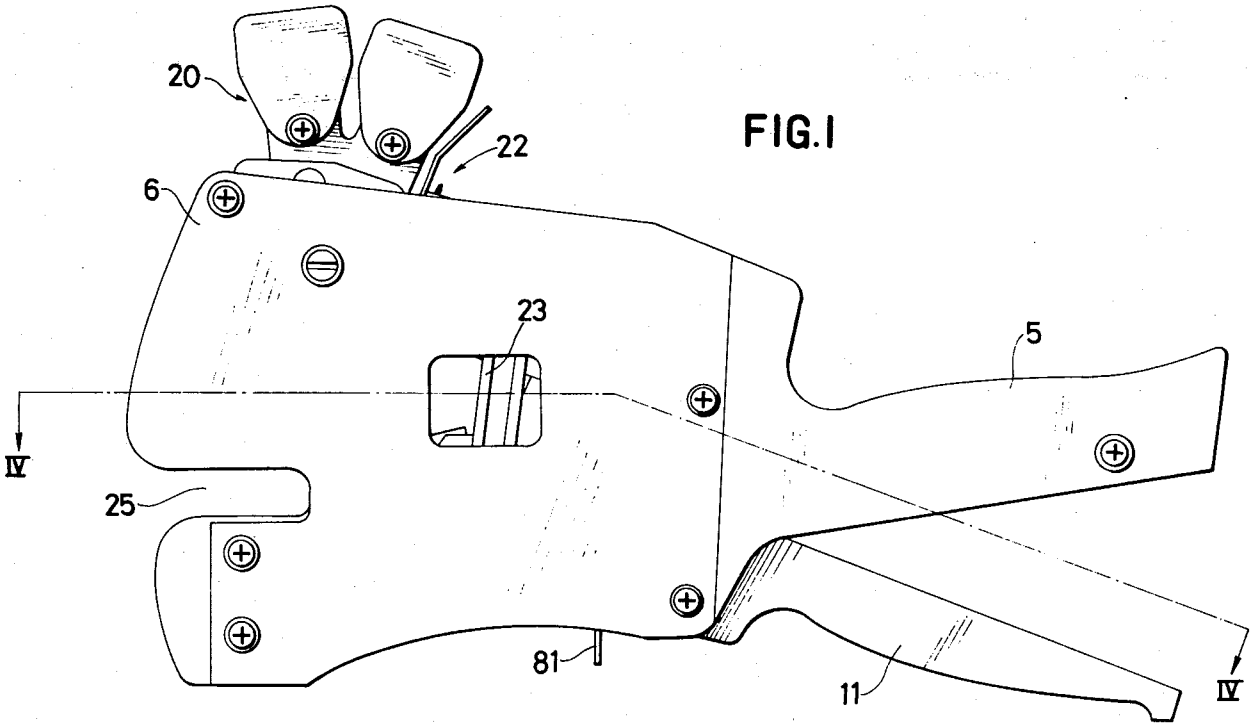
FIG. 1 is a side elevational view showing a portable tagging machine according to the present invention.
Figure 2:
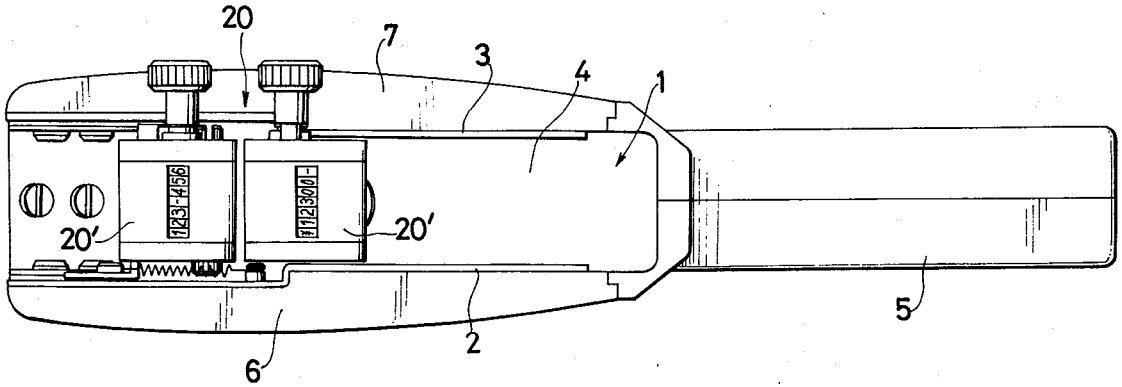
FIG. 2 is a top plan view showing the portable tagging machine of FIG. 1.

Referring to FIGS. 1 to 7 and FIG. 14, two side plates 2 and 3 are connected by a top plate 4 to form a casing 1, from which a grip 5 projects rearwardly. The casing 1 is enclosed by covers 6 and 7. The grip 5 is hollow with its open space extending longitudinally to provide a passageway 9 for a continuous strip 8 of separable tags. In a position near to and below the grip 5 and extending between the side plates 2 and 3, there is a first shaft 10, to which a hand lever 11 is pivotally connected. Two actuating levers 12 and 13 are formed on and extend rigidly forward from opposite sides of the hand lever 11. In a position above the first shaft 10 and on the hand lever 11 is mounted a pin 14. On the grip 5 is mounted a pin 15. Between these pins, a main spring 16 is interposed to bias the hand lever 11 to rotate clockwise (in FIGS. 1, 7, 14, etc.) away from the grip 5 and to a first position.

A pair of yokes 18 and 19 are pivotally connected to opposite sides of the casing 1 above the first shaft 10 by means of a second shaft 17. To the front portions of the yokes 18 and 19, there are attached both a printing mechanism 20, which is equipped with printing heads 20', and a cutting mechanism 22 which is equipped with a cutter 21. The yokes 18 and 19 are pivotally connected to the lever 12 and 13, respectively, through a pair of links 23 and 24, respectively so that the yokes may be actuated by the hand lever 11. In the side plates 2 and 3 and the covers 6 and 7 at their front portions, there is formed an article receiving slot 25, into which an article 104 of clothing to be tagged is inserted. Within the casing 1 and forward of the passageway 9 in the grip 5, there is provided a guide frame 26 which is fixedly secured to the side plates 2 and 3 by means of a pair of pins 27 and 28. In front of the guide frame 26, there is a printing platen 29 and in front of the platen, there is a downwardly facing staple bending member 30, which has bending grooves for bending a staple 108.

Figure 4:
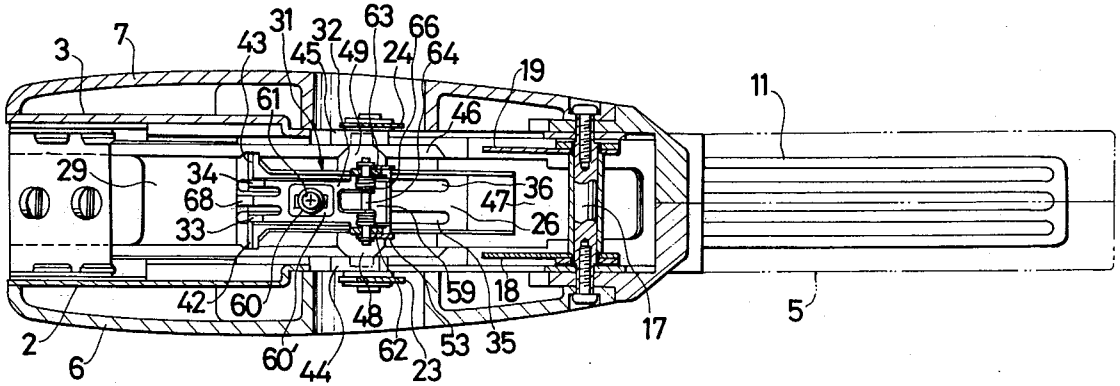
FIG. 4 is a sectional view taken along the line IV—IV of FIG. 1.
Figure 10:
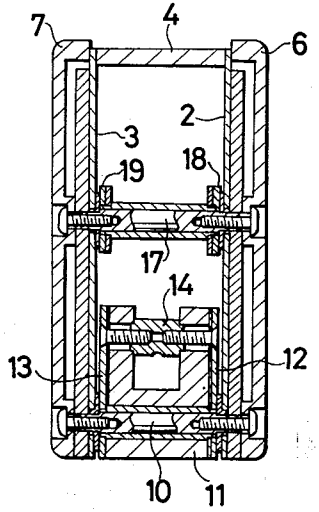
FIG. 10 is a cross sectional view taken along the line X—X of FIG. 6.
Figure 7:
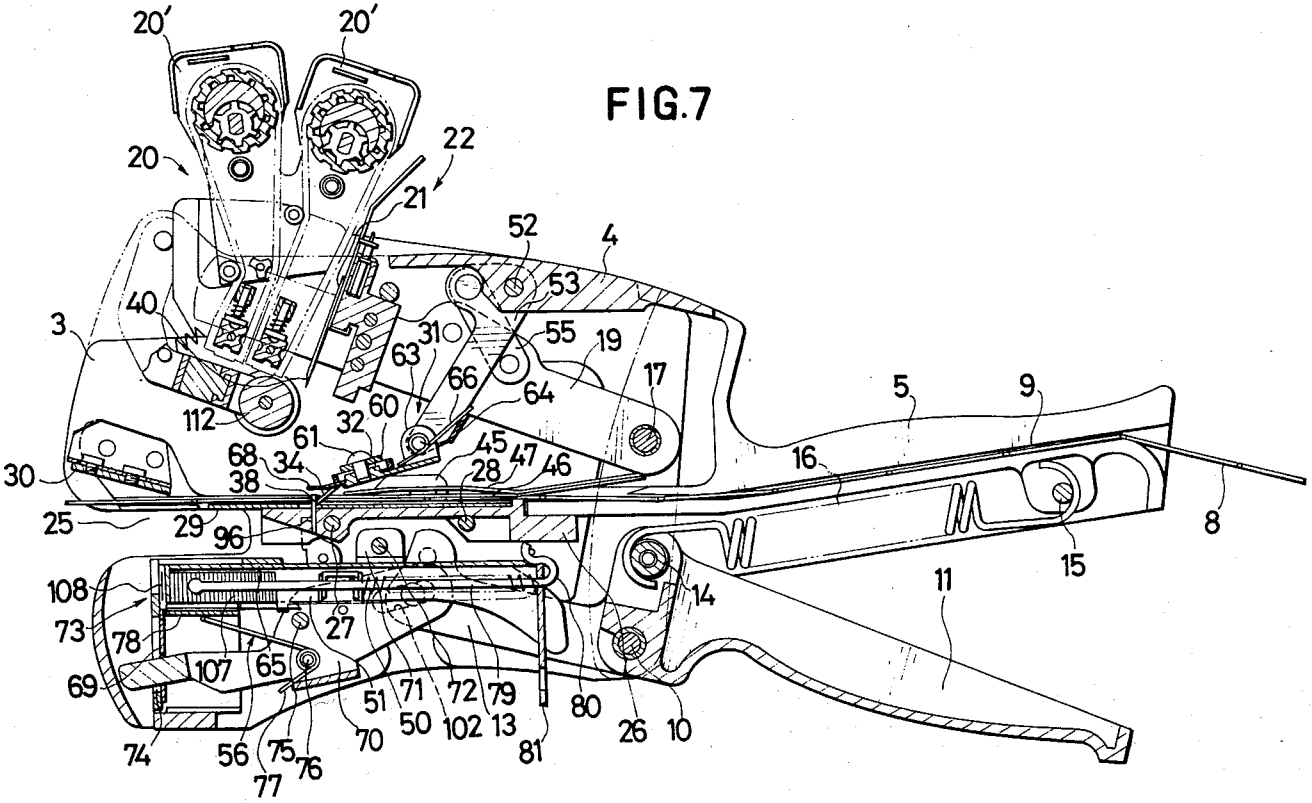
FIG. 7 is a side cross sectional view showing the center section of the portable tagging machine.
Figure 15:
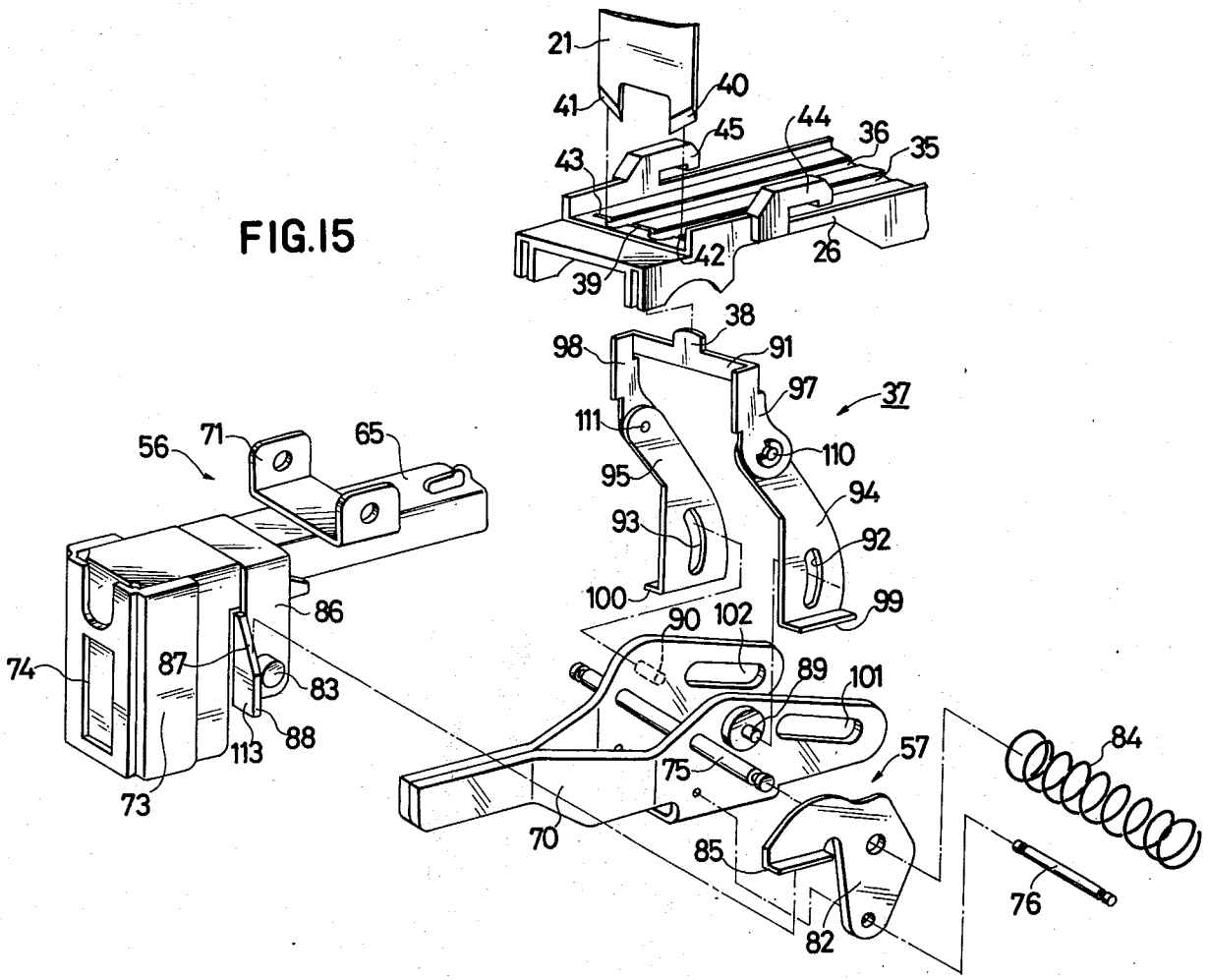
FIG. 15 is an exploded perspective view showing a stapling mechanism, a pressure return mechanism and a strip positioning mechanism of a portable tagging machine.

As shown in FIGS. 4 and 15, the guide frame 26 has grooves 35 and 36 formed in its upper surface. Within these grooves, slide the tips 33 and 34 of a feed pawl 32 of a feed mechanism 31. As shown in FIGS. 4, 11, 12 and 15, there is a strip positioning mechanism 37 for firmly holding the continuous tag strip 8 in position. Mechanism 37 has a stopper 38 that is insertable through the frame 26 at the front end portion of the grooves 35 and 36. The guide frame 26 is formed with a stopper receiving slit 39, in which the stopper 38 is guided to move up and down. The frame 26 has two slits 42 and 43 at the both sides of the stopper slit 39 and extending sideways past the grooves 35 and 36, which slits receive the cutting edges 40 and 41 of the cutter 21 as it moves down. These three slits 39, 40 and 41 are arranged in a line transversely of the guide frame 26. The guide frame 26 has integrally formed with it two J-shaped engagement portions 44 and 45 each respectively formed at a side of guide frame 26 and which protrude therefrom. On the upper surface of the guide frame 26 is placed a guide plate 46 which is cut away so as to allow passage of the pawl tips 33 and 34 and which is biased downward on frame 26 by a leaf spring 47 arranged above plate 46. As seen in FIGS. 4 and 7, the guide plate 46 and the leaf spring 47 are integrally attached at their rear portions. The leaf spring 47 is attached to the guide frame 26 such that the transversely extending lugs 48 and 49 of spring 47 engage inside the J-shaped portions 44 and 45 of the guide frame 26. The guide plate 46 extends near to the upper surface of the printing plate 29 and to the rear lower surface of the bending member 30 so that it may guide the continuous tag strip 8 while clamping it along both sides.

Figure 6:
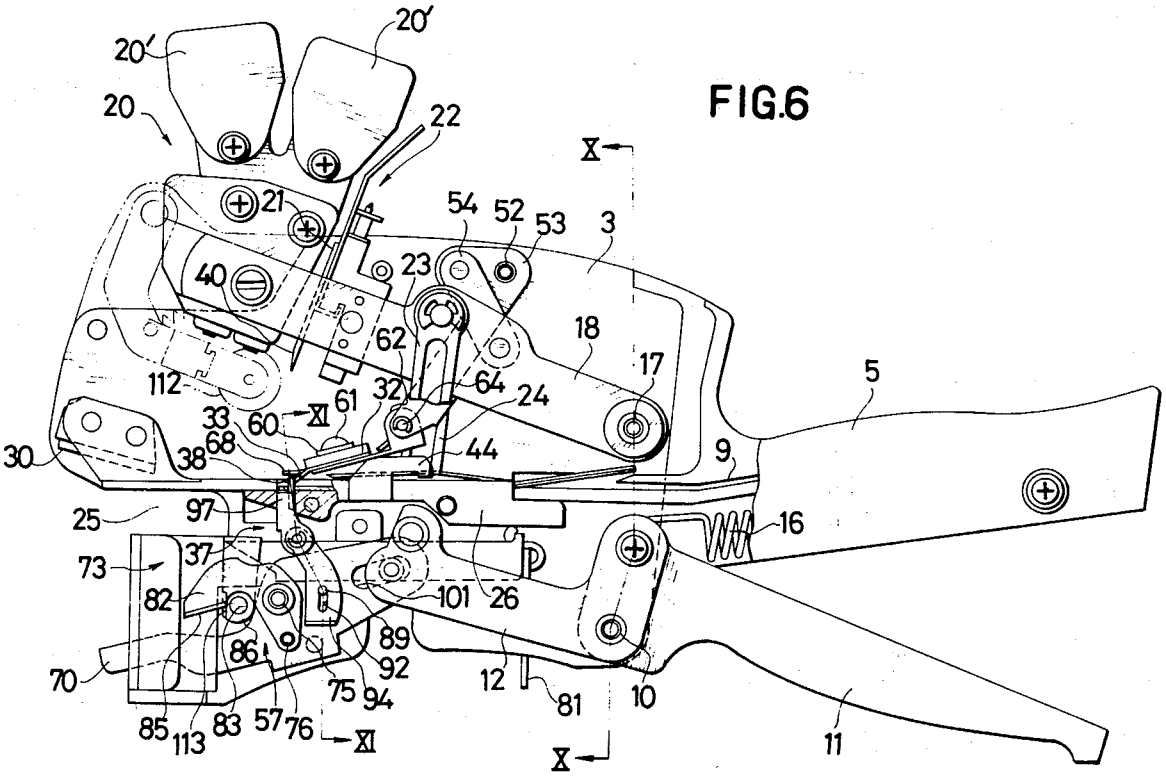
FIG. 6 is also a view similar to FIG. 1, showing a partial cross sectional view of the portable tagging machine with its side plates being removed.
Figure 9:
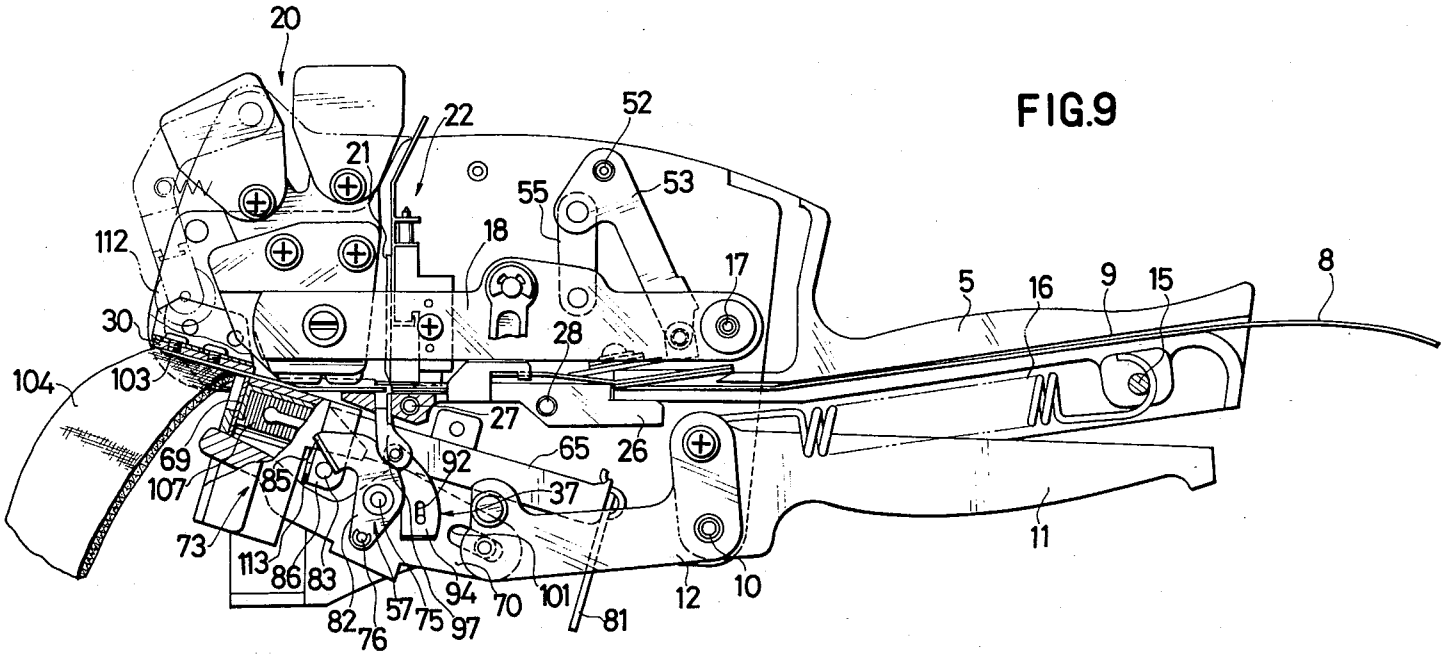
FIG. 9 is a view similar to FIG. 6, showing the condition of the machine in which the hand lever is fully gripped.

To a pin 52 disposed near the top of the casing 1, as shown in FIGS. 6 and 9, there are pivotally connected a pair of bell cranks 53, which in turn are connected to the yokes 18 and 19 through a pair of links 54 and 55. Cranks 53 effect reciprocal movement of the feed mechanism 31 located at a mid portion of the casing 1, and cause the mechanism to feed or index the continuous tag strip 8.

Turning to FIG. 15, an ejector lever 70 is pivotally connected near the bottom of the casing 1 by means of a third shaft 75 in a manner to establish cooperation with the front end portions of the actuating levers 12 and 13 through slots 101 and 102, which are formed at rear end portions of the ejector lever 70. Also at a lower portion of the casing 1, there are a stapling mechanism 56, a pressure return mechanism 57 for the stapling mechanism 56 and the strip positioning mechanism 37 for the continuous tag strip 8. All of these are operated by the action of the ejector lever 70 which, in turn, is pivoted by the actuation of the hand lever 11.

Feed Mechanism

Figure 14:
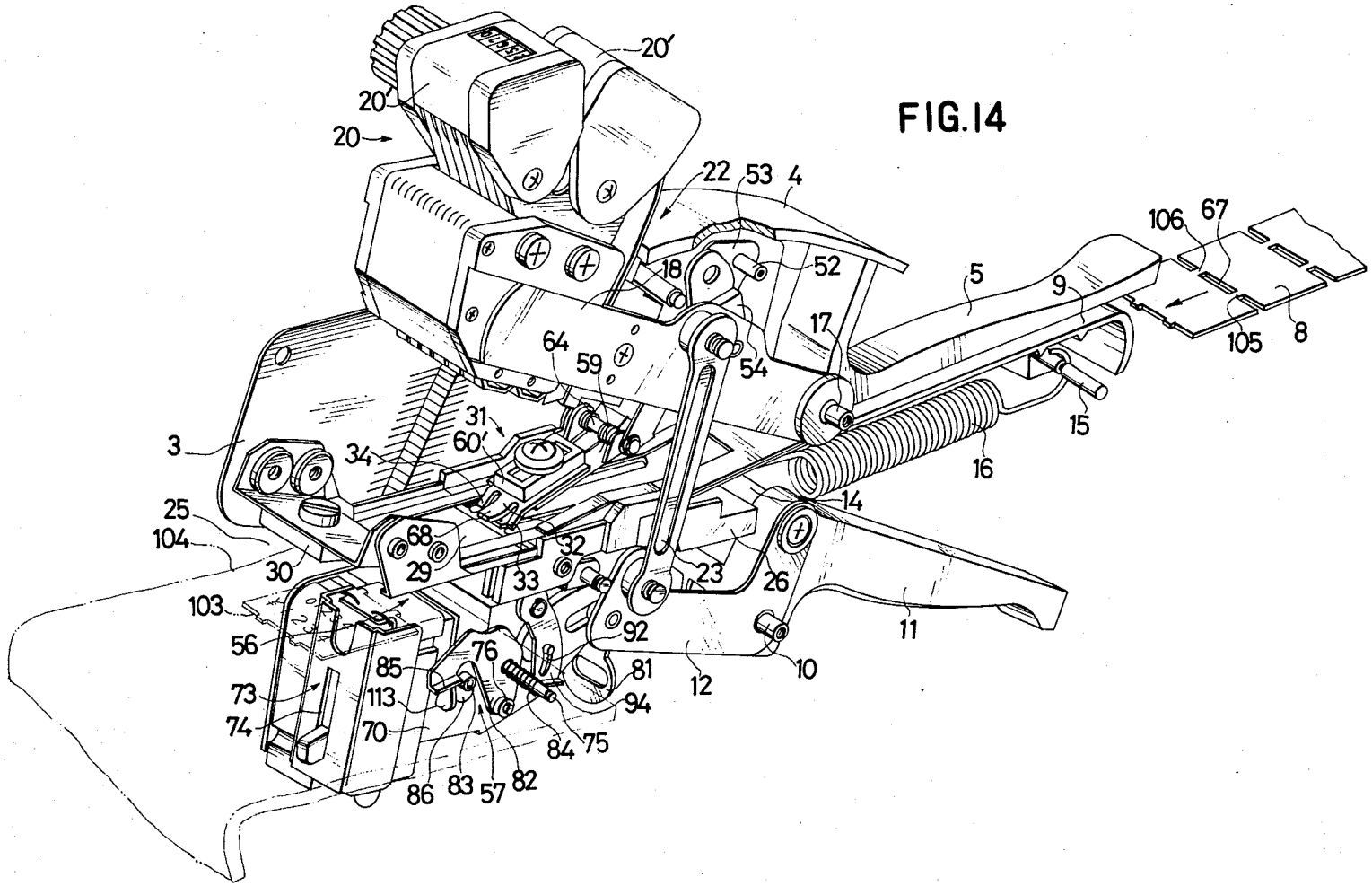
FIG. 14 is a perspective view showing the portable tagging machine with its side plates removed.

In the feed mechanism 31, as shown in FIGS. 4 and 14, the feed pawl 32 is secured to a pawl holder 59 through a washer 60 and a keep plate 60' by means of a bolt 61. The pawl holder 59 has lugs 62 and 63 which are pivotally connected to the lower ends of the bell cranks 53 by means of a pin 64. A torsion spring 66 is mounted on the pin 64 so as to bias the feed pawl 32 counterclockwise. The feed pawl 32 has the pawl tips 33 and 34 formed at both its sides, which tips are engageable with a slit formed between two adjacent tags in the continuous tag strip 8. At its center portion, the feed pawl 32 has a pressure finger 68 which presses down on the tag strip 8 to prevent it from floating or rising. When the feed mechanism is moved to its forward or advanced position, the lower surface of the pressure finger 68 is in position to abuttingly engage the upper extremity of the stopper 38 of the positioning mechanism 37, which will be detailed later.

While the hand lever 11 is in its first or released position, the feed mechanism 31 is located in its forward or advanced position. When the hand lever 11 is gripped and rotated to its second position near the grip 5, the feed mechanism 31 is returned to its retracted position by the actuation of the hand grip 11 through the levers 12 and 13, the links 23 and 24, the yokes 18 and 19, the links 54 and 55 and the bell cranks 53. When the hand lever 11 is released again, the feed mechanism 31 is moved forward by the tension of the main spring 16. While the feed mechanism is moving forward, the tips 33 and 34 of the feed pawl 32 are in sliding engagement with one of the slits 67, which are formed at predetermined spacings along the continuous tag strip 8. In this manner, the tag strip 8 may be indexed or fed a distance corresponding to the length of one tag until the engaging slit 67 reaches a position above the line shared among the stopper slit 39 and the slits 42 and 43, as can be seen from FIGS. 7 and 12.

Stapling Mechanism

Turning to FIGS. 7 and 15, the stapling mechanism 56 includes a staple enclosure 65 which is pivotally connected by pin 72 to the casing 1 and which accommodates within it a block of staples 107. There is an ejector 69 which is operative to push the foremost staple 108 from the staple block 107. A guide head 73 is integrally formed at the front end of the staple enclosure 65 so as to guide the ejector 69 up and down. Ejector lever 70 raises the ejector 69 to separate the foremost staple 108 from the staple block 107 in the staple enclosure 65, to force the separated staple to pierce through the article 104 and further through the separated tag 103, and to clinch the staple 108 on the bending member 30.

Figure 16:
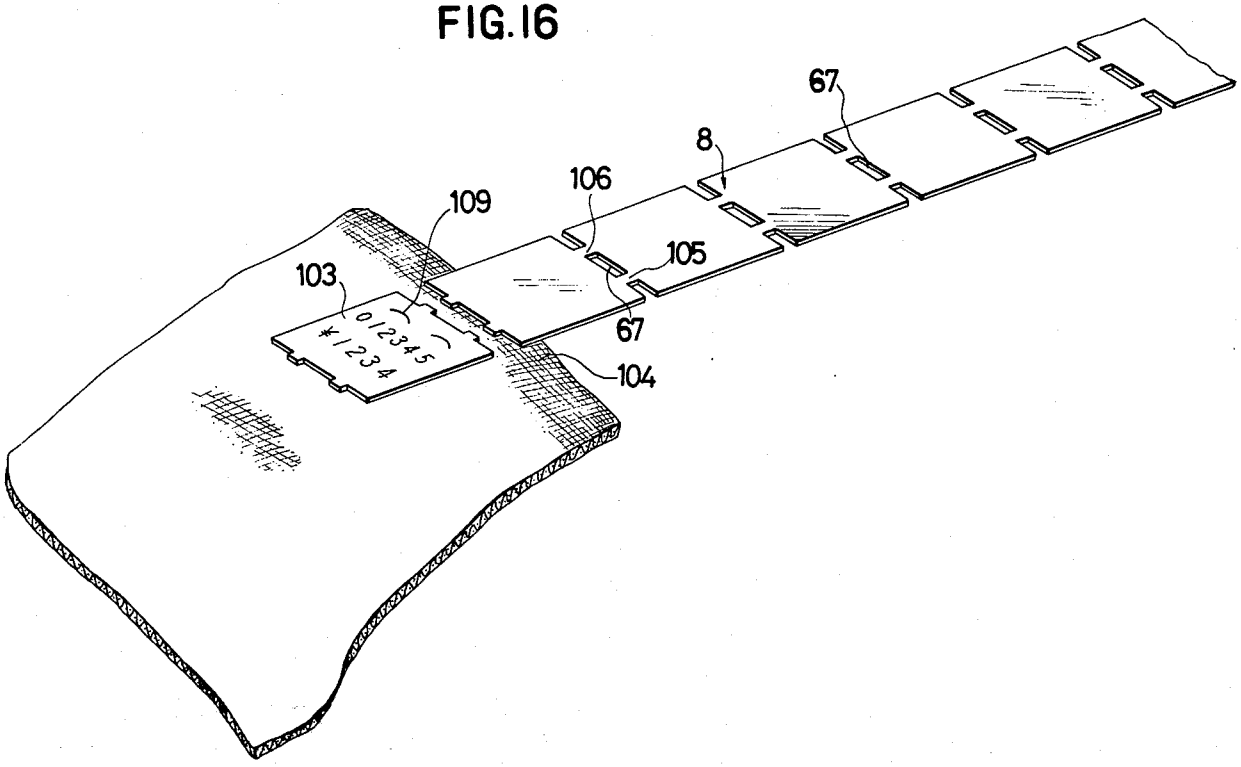
FIG. 16 is a perspective view showing a tag fastened to an article of clothing.

The staple enclosure 65 is pivotally connected to the center portion of the casing 1 by means of a pin 72 at a bracket 71, which is secured to the rear upper portion of enclosure 65. The enclosure 65 rotates on the pin 72 together with the ejector 69 and the guide head 73. The guide head 73 is formed with a guide slot 74 at its front wall. The ejector 69 is made vertically movable while it is in contact with the inside of the front wall of the guide head 73. The ejector is formed with an opening through which the forward end portion of the ejector lever 70 is inserted. Lever 70 is also inserted through and guided by the guide slot 74. Lever 70 moves the ejector 69 up and down. The ejector 69 is separate from the ejector lever 70, and the ejector 69 is movable up and down while being guided within the guide head 73. Thus, each foremost staple 108 can be separated from the staple block 107. As shown in FIGS. 9 and 16, the single separated staple 108 is driven into the article 104 and the tag 103. The staple 108 is then pressed onto the bending member 30 to clinch the bent staple 109.

Figure 13:
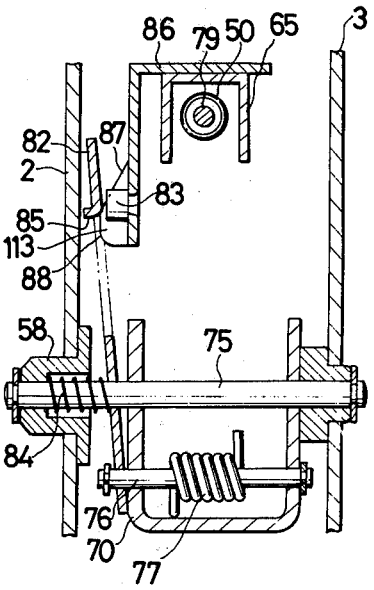
FIG. 13 is a cross sectional view taken along the line XIII—XIII of FIG. 8.
Figure 12:
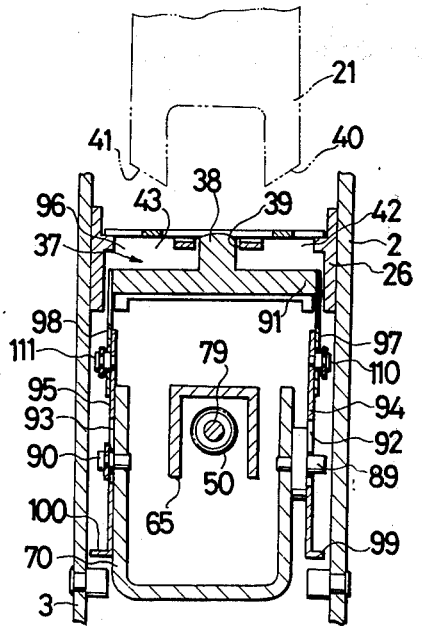
FIG. 12 is a cross sectional view taken along the line XII—XII of FIG. 8.

The ejector lever 70 is pivotally connected midway along its length to the casing 1 by means of the third shaft 75 and is loosely connected to the front ends of the actuating levers 12 and 13 through the slots 101 and 102 which are formed at the rear portion of lever 70. Turning to FIGS. 7 and 13, a pin 76 is mounted in the ejector lever 70 below the third shaft 75. A torsion spring 77 is mounted on the pin 76, so that the ejector lever 70 may be biased to turn counterclockwise on the third shaft 75 because the spring presses against both of a spring holder 78, which is secured to the lower surface of the staple enclosure 65, and against the lower wall (unnumbered) of the ejector lever 70.

As shown in FIG. 7, the staple block 107 is pushed toward the front wall of the guide head 73 by a pressure member 51, which is attached to a bar in a manner to be urged forward by a coil spring 50. The bar 79 is attached to the staple enclosure 65 by means of the rear retaining member 80 of the bar 79 engaging with a retaining groove (not numbered) formed in the rear end of the staple enclosure 65. The bar 79 can be removed from the staple enclosure 65 by pushing it toward the guide head 73 and then pulling down a handle 81, which depends from the retaining member 80, and then by pulling the handle 81 toward the hand lever 11. When, on the other hand, it is intended to load the staple block 107 in the staple enclosure 65, the procedure just described above may be followed in reverse after the staple block 107 has been inserted into the staple enclosure 65 through its rear entrance.

Pressure Return Mechanism

Turning now to FIGS. 6, 8, 9, 13, 14 and 15, the pressure return mechanism 57 includes a rockable push member 82 which is generally U-shaped. Member 82 is mounted to the third shaft 75 and to the pin 76 so that it partially turns together with the ejector lever 70. It also rocks toward and away from the side plates 2 and 3. There is an actuating member 86 for the push member 82. Member 86 is integral with one side of the staple enclosure 65 and depends therefrom. Member 86 causes the rocking motion of push member 82. There is a projection 83 on the actuating member 86. The projection 83 projects from a lower portion of the actuating member 86. Projection 83 is engageable with the rockable push member 82 when the stapling mechanism 56 returns downward.

The push member 82 is normally urged toward the staple enclosure 65 by a coil spring 84, which is mounted around the third shaft 75 and which is interposed between the inside of a holding member 58 secured to the side plate 2 and the outside of the push member 82. Member 82 is bent outwardly with such a roundness as allows smooth sliding movement.

A fin 113 is formed at the front end of the actuating member 86 adjacent to the projection 83. Fin 113 has an inclined edge 87 which is operative to thrust the rocking push member 82 toward the side plate 2 and against spring 84. Fin 113 also has a flat edge 88 which merges into the lower portion of the inclined edge 78 of the fin.

As can be better seen from FIGS. 13 and 15, the inclined edge 87 extends downwardly from the front upper portion of the actuating member 86 until it reaches the center of the projection 83. The widest (lower) portion of edge 87 is positioned at a greater height above the surface of member 86 than the outside end face of the projection 83. The widest portion of the inclined edge 87 merges into the flat edge 88 of the fin 113, which is located below the inclined edge 87.

Figure 8:
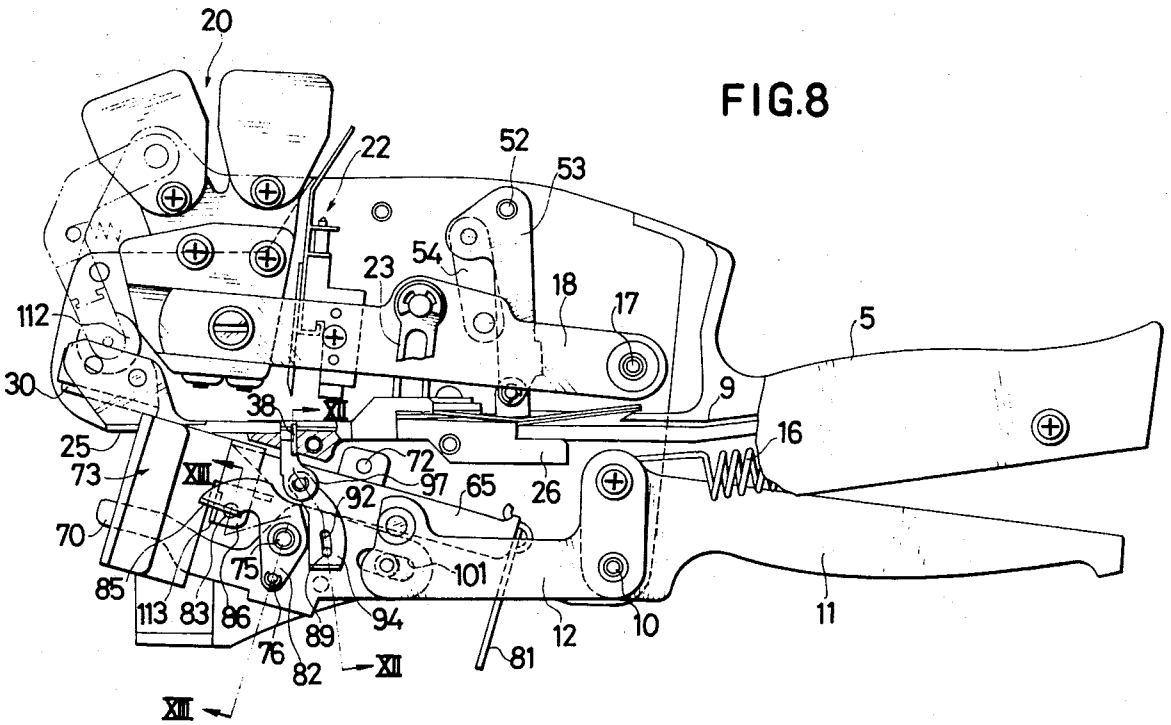
FIG. 8 is a view similar to FIG. 6, showing the condition of the machine in which the hand lever is gripped midway of its stroke.

When the hand lever 11 is gripped and closed halfway through its full stroke, as shown in FIG. 8, the staple enclosure 65 and the ejector lever 70 turn clockwise together, enclosure 65 on the pin 72 and ejector lever 70 on the third shaft 75, until the front upper end of the staple enclosure 65 is in abutting engagement with the bending member 30. Because the distance between the projection 83 and the pin 72 is larger than the distance between the engagement lug 85 and the third shaft 75, the obtainable upward displacement of the projection 83 can be larger than the displacement of the engagement lug 85 of the push member 82. Thus, as gripping of the hand lever 11 proceeds, the rocking push member 82 is guided by means of the engagement of its lug 85 with the inclined edge 87 of the fin 113 and member 82 is pushed toward the outer side plate 2 while compressing the coil spring 84 until the full extent of edge 87 has been passed and member 82 then rides upon the flat edge 88 of the fin 113. The condition as shown in FIG. 8 will be referred to as the half grip condition.

When the hand lever is gripped beyond the half grip condition, the ejector lever 70 continues turning on the third shaft 75 to raise the ejector 69. This raising stops when the ejector 79 abuts against the bending member 30. When the hand lever is gripped to its full stroke, as shown in FIG. 9, the engagement lug 85 is raised above and thus does not engage the outer end face of the projection 83. Meanwhile, the rockable push member 82 is being urged toward the staple enclosure 65 by the coil spring 84. Being above projection 83 and being pivoted away from engagement with fin 113, the engagement lug 85 of the push member 82 engages the upper outer or annular periphery of the projection 83. This condition is referred to as the full grip condition.

When the hand lever 11 is released from the full grip condition, the ejector lever 70 and the rocking push member 82 both start counterclockwise rotation on the third shaft 75. As the rotation of the push member 82 proceeds, the engagement lug 85 slides forward of the labeler and pushes the projection 83 down while maintaining its engagement with the upper outer periphery of the projection 83. Since this projection 83 is integral with the staple enclosure 65 through the actuating member 86, the staple enclosure 65 is simultaneously pushed down to establish the release condition shown in FIGS. 6 and 7. Since, more specifically, the front end of the staple enclosure 65 is moved downward away from the bending member 30 simultaneously with the releasing of the hand lever 11, which release causes advance of the tag strip, the staple enclosure 65 never obstructs the advance of the continuous tag strip.

As push member 82 continues to move counterclockwise with lever 70, it engages and moves down along inclined edge 87. This eventually rocks push member 82 free of projection 83 and permits the push member to fully descend. But, by that time, the staple enclosure is down and out of the way of tag strip 8.

Strip Positioning Mechanism

Turning to FIGS. 6, 8, 9, 11 and 15, the strip positioning mechanism 37 rides on a pair of pins 89 and 90, which extend sideways from the ejector lever 70. The mechanism includes a positioning member 91 which has a stopper 38 that moves up and down through the stopper slit 39 of the guide frame 26. Member 91 further includes a pair of opposed connecting plates 94 and 95 which have upper portions that are pivotally connected through pins 110 and 111 to the lower ends of side portions 97 and 98 of the positioning member 91. Plates 94 and 95 have lower portions with slots 92 and 93 therethrough, into which the pins 89 and 90 are inserted. The stopper 38 acts together with the pressure finger 68 of the feed pawl 32, as will be discussed later in detail.

The connecting plates 94 and 95 have their lower or foot portions 99 and 100 bent outwardly toward the side plates 2 and 3 so that their outer extremities may abut against the inside walls of the side plates 2 and 3. This prevents the pins 89 and 90 from becoming disengaged from the slots 92 and 93. The positioning member 91 has a center portion, which is arranged parallel to and across the slit 67 of the continuous tag strip 8. Positioning member 91 also has two side portions 97 and 98 which are parallel to the side plates 2 and 3. The stopper 38, which extends up from the center portion of the member 91, is guided to move within the stopper slit 39 of guide member 26. In order to allow the vertical movement of the entire positioning member 91, a positioning groove 96 is formed in the guide frame 26 below the stopper slit 39. Groove 96 has substantially the same length across guide frame 26 as the width of the guide frame 26.

Figure 11:
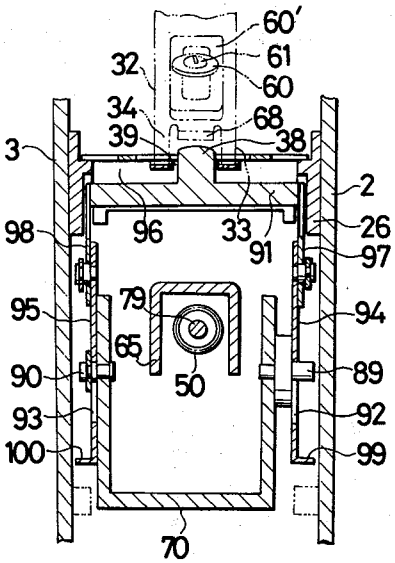
FIG. 11 is a cross sectional view taken along the line XI—XI of FIG. 6.
Figure 3:
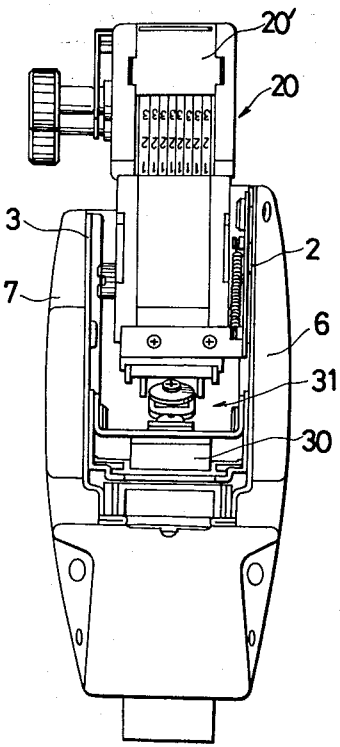
FIG. 3 is a front elevational view showing the portable tagging machine of FIG. 1.
Figure 5:
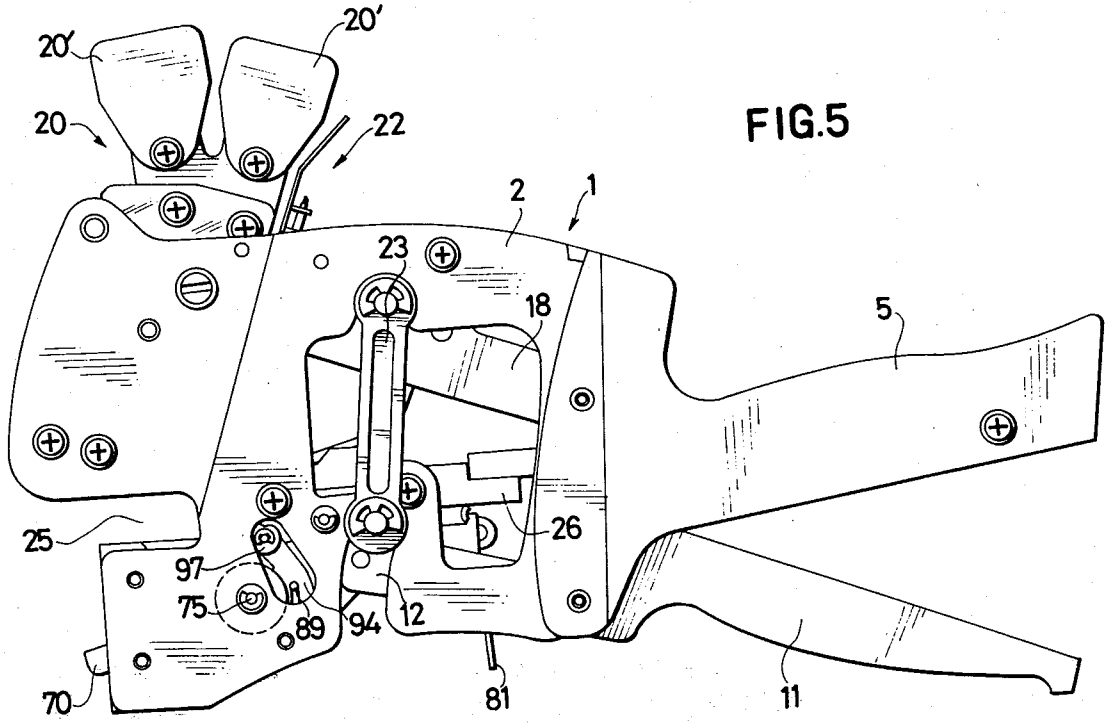
FIG. 5 is a view similar to FIG. 1, showing the portable tagging machine with its covers removed.

When the hand lever 11 is released and is in the position shown in FIG. 6, in order to move the feed mechanism 31 to its advanced position, at which the pressure finger 68 of the feed pawl 32 is positioned above the stopper 38 of the positioning member 91, the pins 89 and 90 are located, as seen in FIG. 11, in the uppermost positions of the slots 92 and 93 of the connecting plates 94 and 95, which thereby raises the plates 94 and 95. As a result, the positioning member 91 is also raised, because of its pivotal connection to the connecting plates 94 and 95, to a sufficient extent to cause the stopper 38 to protrude upward from the upper level of the guide frame 26 and thus to bring the upper edge of the stopper into abutment with the lower face of the pressure finger 68 of the feed pawl 32, as is apparent from FIG. 7. Meanwhile, the stopper 38 also extends into the slit 67 of the continuous tag strip 8. The tag strip 8 is thus locked in position against shifting.

When the hand lever 11 is so gripped that the ejector lever 70 turns clockwise on the third shaft 75, then the pins 89 and 90 move downward along the slots 92 and 93 of the connecting plates 94 and 95. Because the positioning member 91 remains stationary, without being lowered by the regulating action of the slots 92 and 93, the stopper 38 remains in the slit 67 of the tag strip 8. Thus, there is no danger of the tag strip 8 being entrained or carried backward even if the strip is drawn backward by the frictional force resulting from the backward movement of the feed pawl 32.

When the pins 89 and 90 move further downward far enough to engage and push down on the lower walls of the slots 92 and 93, the connecting plates 94 and 95 are thereby lowered. The positioning member 91 is accordingly lowered and this extracts the stopper 38 from the slit of the tag strip 8. When the hand lever 11 is gripped to its full stroke, the stopper 38 is removed completely from the slit 67 of the strip 8, thus readying the strip 8 for being fed.

When the hand lever 11 is released from the gripped condition, the pins 89 and 90 move upward along the slots 92 and 93, while leaving the connecting plates 94 and 95 and the positioning member 91 in their lowered positions. At the same time, the feed pawl 32, which is being carried forward, keeps its tips 33 and 34 fitted in the slits 67 so as to feed the continuous tag strip 8. During this period, because the positioning member 91 is held at its lower position, the leading edge of its stopper 38 is located below the upper surface of the guide frame 26. Thus, the stopper 38 does not block the advance of the tag strip 8.

When the slit 67 approaches a position above the stopper 38 as the tag strip 8 advances, as seen in FIG. 11, the pins 89 and 90 finally engage the upper walls of the slots 92 and 93 and this raises both the connecting plates 94 and 95 and the positioning member 91. As a result, the stopper 38 is also raised and protrudes through the stopper slit 39. The tag strip 8 is raised to a height that corresponds to the protrusion of the stopper 38 from the upper surface of the guide frame 26. During this rising operation, the tag strip 38 is being carried, while it is being depressed by the pressure finger 68 of the feed pawl 32, to the position of the stopper 38 of the positioning member 91, until it restores engagement with the stopper 38.

When the slit 67 in the tag strip 8 is positioned above the stopper 38 of the positioning member 91 and with the hand lever 11 released to its full openness, the upraised stopper 38 fits in the slit 67. Since the leading edge of the stopper, which is protruding through the slit 67, is also abutting the lower surface of the pressure finger 68 of the feed pawl 32, there is no undesired shifting of the continuous tag strip 8, and shifting of the strip does not begin until the hand lever 11 is gripped to its full stroke.

Operation of Tagging Machine

The sequential operation of the portable tagging machine of the present invention will be described in the following.

The staple block 107 is loaded. To do this, the portable tagging machine is turned upside down and the stapling mechanism 56 is loaded with the staple block 107. Prior to this loading operation, the bar 79 is pulled rearward and removed from the staple enclosure 65. The staple block 107 is then inserted into the staple enclosure 65 with the legs of the staples being directed toward the guide frame 26. Then, the rear end of the staple block 107 is pressed further into the inside of the staple enclosure 65 by the leading end of the pressure member 51 of the bar 79. The bar 79 is then fixed such that its retaining member 80 is retained at the rear end of the staple enclosure 65. Now the device is ready to staple the printed tag 103 to the article 104.

As shown in FIGS. 7 and 14, the continuous tag strip 8 is fed into the casing to pass along the passageway 9 of the grip 5 and then through the space between the guide frame 26 and the guide frame 46 until the leading tip of the tag strip abuts against the stopper 38 protruding upward from the guide frame 26. Then, the hand lever 11 is gripped, as shown in FIG. 9. This carries back the feed mechanism 31 so that the tips 33 and 34 of the feed pawl 32 approaches the rear edge of the front tag 103 of the tag strip 8. After this, the hand lever 11 is released, as shown in FIGS. 6 and 7. This advances the feed mechanism 31 which brings the tips 33 and 34 into engagement with the slit 67 of the tag strip 8, thereby to feed the strip 8 until the slit 67 is moved to the same line shared among the stopper slit 39 of the guide frame 26 and the slits 42 and 43 for the cutter 21.

In this position, the foremost tag 103 is moved upon the upper surface of the printing plate 29, and the tag strip 8 is in such a condition that its slit 67 is in engagement with the stopper 38 protruding through the stopper slit 39. The tag strip 8 is prevented from floating by the pressure plate 68 of the feed pawl 32.

When the hand lever 11 is now gripped a second time, a desired inscription, such as price or other information, is printed upon the foremost tag 103 by the printing mechanism 20, while the uncut portions 105 and 106, which are formed at the rear edge of the tag 103, are cut by the cutting mechanism 22. When the hand lever 11 is subsequently released, the single printed tag 103, which has its rear edge cut and separated from the rest of the tag strip 8, is pushed by the tag strip 8 to stop in the vicinity of the lower surface of the bending member 30. Since the guide plate 46 has its two front side portions extending forward, as has been reviewed previously, the single tag sheet 103 never falls down erroneously from the vicinity of the member 30.

For stapling the tag 103 to the article 104, the hand lever 11 is gripped a third time after the article 104 has been inserted into the article receiving slot 25 of the casing 1. This will be described in detail below.

First, the portable tagging machine is held in one hand of an operator, and the article 104 to be tagged is held in the other hand. That portion of the article 104 which is to receive the tag is manually inserted into the article receiving slot 25. Thus, when the hand lever 11 is gripped, as shown in FIG. 8, against the biasing force of the main spring 16, the ejector lever 70 is turned clockwise upon the third shaft 75 to actuate the stapling mechanism 56. As this turning motion proceeds, the staple enclosure 65 is also turned clockwise upon the pin 72. As a result, the guide head 73 is lifted, and this presses the article 104 and the tag 103 that are in the slot 25, between the front upper edge of head 73 and the bending member 30.

The clockwise rotations of the ejector lever 70 and of the staple enclosure 65 causes the rockable push member 82 to rotate upon the third shaft 75. The fin 113 rises, and this rocks and pushes the member 82 toward the side plate 2, because the inclined edge 87 of fin 113 is sliding on the engagement lug 85 on member 82. The pins 89 and 90 are, however, turned counterclockwise to descend along the slots 92 and 93.

Even after the guide head 73 reaches its highest stop position shown in FIG. 9, the ejector lever 70 continues its clockwise rotation on the third shaft 75, independently of the guide head 73, to a higher position. As a result, the ejector 69 ejects and raises the foremost staple 108 from the staple block 107 within the staple enclosure 65. The staple 108 pierces through the article 104 and through the printed tag 103 until it abuts against the bending grooves in the member 30. The bending grooves properly clinch the legs of the staple 108 to fasten the tag 103 to the article 104.

In the meantime, the rocking push member 82, which has been thrust by the fin 113 toward the side plate 2 to ride upon the flat edge 88, as shown in FIG. 13, has its engagement lug 85 guided by the inclined edge 87 to ride past the outside end face of the projection 83. Then, the engagement lug 85 fails to maintain engagement with the outside end face of the projection 83 but instead engages the upper outer periphery of that projection.

Also, the pins 89 and 90 push against the lower walls of the slots 92 and 93 so that the stopper 38 of the positioning member 91 may descend from the upper surface of the guide frame 26.

Meanwhile, the actuating lever 12 and 13 are turned counterclockwise on the first shaft 10 so that the yokes 18 and 19 may be lowered by the links 23 and 24 and rotate counterclockwise upon the second shaft 17. As a result, the printing mechanism 20 and the cutting mechanism 22 are lowered together, and the desired inscription is printed by the printing mechanism 20 on a predetermined portion of the foremost tag 103 of the tag strip 8 then on the printing plate 29. During this operation, an inking roller 112 is caused to retract by moving past the printing mechanism and pivoting out of the way, after the inking roller has supplied ink to the printing surfaces of the printing heads 20'. The inking roller 112 thus does not obstruct the descent of the printing mechanism 20.

Referring to FIG. 15, the cutting edges 40 and 41 of the cutter 21 are simultaneously forced into the slits 42 and 43 to cut the uncut portions 105 and 106 of the tag strip 8 at both sides of the slit 67.

The counterclockwise rotation of the yokes 18 and 19, as described above, turns the bell cranks 53 on the pin 52 in the same direction through the links 54 and 55, so that the feed mechanism 31 is carried back to bring the tips 33 and 34 of the feed pawl 32 to the rear of the next slit 67 on the tag strip 8 at the tag adjacent to the one on the printing plate 29.

When the hand lever 11 is subsequently released, the actuating lever 12 and 13 are returned clockwise. By their rotational motion, the yokes 18 and 19 are turned in the same direction upon the second shaft 17, while the ejector lever 70 is turned in the opposite, counterclockwise direction on the third shaft 75. Simultaneously with the ejector lever 70 starting its rotation in this direction, the rocking push lever 82 rotates counterclockwise to let its engagement lug 85 push down on the upper outer periphery of the projection 83, thereby to lower the staple enclosure 65 so that the leading end of the staple enclosure 65 is promptly separated from the article 104 which has been tagged. As the ejector lever 70 continues its counterclockwise rotation, the engagement lug 85 advances, to the left in FIGS. 6 and 15, while lug 85 slides over the upper outer periphery of the projection 83, to lower the guide head 73. At the instant that the sliding contact between the rear end of the engagement lug 85 and the upper outer periphery of the projection 83 is finished, the lug 85 stops upon the inclined edge 87 of the fin 113, thus establishing the condition shown in FIG. 6. Immediately before the counterclockwise rotation of the ejector lever 70 is finished, the positioning member 91 is lifted by the raising action of the pins 89 and 90 pressing against the upper walls of the slots 92 and 93, which causes the stopper 38 to protrude upward through the stopper slit 39 of the guide frame 26.

As the yokes 18 and 19 rotate clockwise, on the other hand, the printing mechanism 20 and the cutter 21 are raised, and the feed mechanism 31 is carried forward in the feed direction through the links 23 and 24 and the bell cranks 53. Midway through the advance of the feed mechanism 31, the tips 33 and 34 of the feed pawl 32 engage the slit 67 of the tag strip 8 so as to feed the strip.

Meanwhile, the tag strip 8 can advance smoothly, without any obstruction, because the printing mechanism 20 and the cutter 21 are located in their elevated positions away from the tag strip while the stopper 38 of the positioning member is positioned below the upper surface of the guide frame 26, and because there is no obstacle, such as the article 104 and the tag 103, between the bending member 30 and the staple enclosure 65 now located in its lower position. As the feed pawl 32 approaches the slits 42 and 43, the tag strip 8, which has been held in a slightly elevated position by the upper edge of the stopper 38, is carried forward at the same time it is being pressed down by the pressure finger 68 of the feed pawl 32. When tag strip slit 67 finally reaches a position just above the stopper 38, the strip settles over the stopper. This instantly stops the tag strip 8 at that particular position, thus accomplishing the desired positioning.

Since the edge of the stopper 38 of the positioning member 91 is for a while thereafter in abutting engagement with the lower surface of the pressure finger 68 of the feed pawl 32, the tag strip 8 is prevented from floating and moving back and forth and it is reliably fixed in that position. After this positioning operation, the article 104 to which the printed tag 103 has been fastened by means of the bent staple 109, can be removed from the slot.

As has been described hereinbefore, the following results can be obtained according to the present invention. Simultaneously with the release of the hand lever after a printed tag is fastened to an article of clothing by means of a staple the staple enclosure is promptly lowered to place no obstacle to the subsequent advance of the continuous tag strip. Thus, the tag strip can be fed reliably and smoothly without clogging of the tags in the machine casing. Moreover, while the tag strip is not being fed, the stopper is fitted in a slit of the tag strip to firmly hold the tag strip in position. Thus, the tag strip is neither moved during the backward stroke of the feed pawl nor is it pulled out of the machine even if the foremost tag is not severed completely from the strip. The tag can be printed clearly because the tag strip is prevented from shifting during printing. The printing of tags and their attachment to desired articles, including garments, can be accomplished by a simple manual gripping action at any counter of a shop. Also, a price tag correcting operation can also be accomplished, in which a new tag printed with a new price is attached over the old tag printed with the old price.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. A tagging machine for tagging articles, comprising:

a casing having a front portion at one end and a rear portion at its opposite end; an article receiving means at said casing one end for receiving an article to be tagged; a grip by which said machine is held, said grip being attached at said casing opposite end; a passageway into said casing from the direction of its said rear portion toward said article receiving means for transmitting a continuous strip of tags therealong;

a lever for operating said machine; a pivot mount for said lever and said lever being pivotally mounted to its said pivot mount and being located in said casing; said lever extending through said casing rear portion and extending near said grip; said lever being movable between a first position and a second portion; biasing means for normally biasing said lever to said first position;

feed means for engaging and feeding a continuous strip of tags along said passageway to said article receiving means; said feed means including pawl means located in and movable along said passageway and being movable toward and away from said article receiving means; said pawl means being engageable with the strip of tags upon movement of said pawl means toward said article receiving means and being disengageable from the strip of tags upon movement of said pawl means in the opposite direction; first link means linking said pawl means to said lever in a manner such that movement of said lever toward its said second position moves said pawl means away from said article receiving means and movement of said lever toward its said first position moves said pawl means toward said article receiving means;

a platen located in said passageway and facing toward a printing means, said platen being provided for having a tag to be printed rest thereupon; printing means facing towards said platen for printing and inscription upon a tag in a strip of tags in said passageway, which tag is the one in the strip then located on said platen; second link means linking said printing means with said lever in a manner such that movement of said lever to its said second position moves said printing means against said platen to print the tag then on said platen and movement of said lever to its said first position moves said printing means off said platen;

tag strip cutting means comprising a cutting blade for cutting the strip of tags; third link means linking said cutting means with said lever in a manner such that movement of said lever to its said second position moves said cutting blade across said passageway and movement of said lever to its said first position raises said cutting blade away from said passageway and away from the strip of tags; said cutting blade being so located and movable that it moves across said passageway at a location selected to be where neighboring tags in the strip thereof will be joined;

tag attaching means located further along said passageway toward said casing front portion than said printing means and said cutting means; said tag attaching means being positioned at said article receiving means and being adapted to attach together an article to be tagged and a tag then at said article receiving means; fourth link means linking said lever and said tag attaching means in a manner such that upon movement of said lever to its said second position, said tag attaching means engages the article and the tag then at said article receiving means and attaches them together, and upon movement of said lever to its said first position, said tag attaching means is moved away from said article receiving means and the article and the tag therein;

pressure return means engageable with said tag attaching means for forcing said tag attaching means away from said article receiving means; fifth link means linking said pressure return means with said lever such that said pressure return means engages said tag attaching means to force said tag attaching means away from said article receiving means upon said lever beginning to move to its said first position;

positioning means for a strip of tags, including a stopper movable into and out of said passageway; said stopper being shaped and oriented to be received in a slit between two adjacent tags of a strip thereof located in said passageway; sixth link means linking said strip positioning means and said lever for moving said stopper into and out of said passageway in a sequence of operation of said stopper such that said stopper is in said passageway when said lever is in said first position and when said lever is moving to said second position, is out of said passageway when said lever has moved to said second position and returns to be in said passageway as said lever is returning from said second position to said first position.

2. The tagging machine of claim 1, wherein said printing means is nearer to said article receiving means than said cutting means is near to said article receiving means.

3. The tagging machine of claim 2, wherein said second and said third link means are comprised of the same link means.

4. The tagging machine of claim 1, wherein said pawl means comprises a pawl holder; a pivot mount on said first link means for said pawl holder; a feed pawl secured to said pawl holder and engageable with the strip of tags in said passageway; means for holding said pawl continuously in engagement with the strip of tags in said passageway as said pawl means moves along said passageway.

5. The tagging machine of claim 4, wherein said feed pawl comprises pawl tips separated from each other on the opposite sides of said pawl holder and engageable with the strip of tags along the opposite side edges thereof; said pawl tips being engageable with a slit between neighboring tags of a continuous strip of tags; a pressure finger formed at a center portion of said pawl holder; means for pressing said pressure finger continuously against the surface of the strip of tags during the travel of said pawl means toward said article receiving means, thereby to prevent the strip from rising.

6. The tagging machine of claim 4, wherein said first link means includes at least a second lever pivotally connected to the said lever and includes at least one yoke pivotally connected to said second lever at one location on said yoke and pivotally connected to said casing at a different location on said yoke such that said yoke pivots with the said lever; the said pivot connections to said yoke being so arranged that upon said lever being pivoted toward its said second position, said yoke pivots in a first angular direction and upon said lever pivoting to its said first position, said yoke pivots in a second angular direction opposite to said first angular direction; a bell crank pivotally connected to said yoke and to said casing and being in engagement with said pawl means such that pivotal motion of said yoke, through said bell crank, causes the said movement of said pawl means.

7. The tagging machine of claim 6, wherein said printing means comprises a printing head attached to said yoke and movable therewith; said yoke being pivotally mounted on its respective said pivots for causing the recited said movement of said printing means.

8. The tagging machine of claim 6, wherein said cutting blade of said cutting means is attached to said yoke and is movable therewith; said yoke being pivotally mounted on its respective said pivots for causing the recited said movement of said cutting blade of said cutting means.

9. The tagging machine of claim 1, wherein said tag attaching means is a stapling means for stapling the tag to the article to be tagged; said stapling means including a staple ejector and a means for pressing the ejected staple through the article and the tag; said fourth link means being linked to said staple ejector and said means for pressing the ejected staple in a manner such that upon movement of said lever to its said second position, said staple ejector and said means for pressing the ejected staple are in position to and are operative to press a staple through the article and the tag that is then at said article receiving means.

10. The tagging machine of claim 9, wherein said stapling means further comprises a staple holding enclosure which is pivotally connected to said casing; a guide head for said ejector; said guide head being attached to said staple enclosure at the end thereof at which said ejector is located; said guide head including a guide slot for guiding motion of said ejector;

said stapling means further comprising an ejector lever pivotally connected to said lever such that movement of said lever to its said second position moves said ejector lever to eject a staple from said staple enclosure; spring means interposed between said staple enclosure and said ejector level for urging the same apart; said ejector being in engagement with and being guided within said guide slot of said guide head; said ejector being movable toward and away from said article receiving means; said ejector being engageable by said ejector lever upon motion of said ejector lever toward said article receiving means, thereby to moved by said ejector lever; said ejector being movable by being engaged by said ejector lever to separate a staple from the staples in said staple enclosure and to force the separated staple to pierce through the article and through the tag located in said article receiving means.

11. The tagging machine of claim 10, further comprising a bending member mounted to said casing in the vicinity of said article receiving means and having a surface facing toward said ejector and said staple enclosure; said bending member surface having bending grooves therein adapted for bending and clinching a staple; said ejector and said bending member grooves being so positioned that staples are moved into said bending grooves to be clinched, and said bending grooves being adapted to clinch each separated staple in the said bending grooves, thereby to complete the fastening of the printed tag to the article being tagged.

12. The tagging machine of claim 10, wherein said stapling means further includes a pressure plate movably mounted in said staple enclosure and normally pressing staples toward said ejector; spring means in said staple enclosure for so urging said pressure plate; a bar attached to said pressure plate and being engageable with said staple enclosure for being held in position and for holding said pressure plate in position.

13. The tagging machine of claim 10, wherein said pressure return means includes a rockable push member which is pivotally mounted to said ejector lever so as to pivot with respect thereto, and also being mounted to be movable sideways with respect to said casing and said ejector lever toward and away from said ejector lever; said rockable push member being formed with an engagement portion; engageable means on said staple enclosure positioned to be engaged by said push member when the latter is being moved by said ejector lever away from said article receiving means, thereby causing said push member to push said staple enclosure and said ejector away from said article receiving means.

14. The tagging machine of claim 13, wherein said engageable means on said staple enclosure comprises:

an actuating member attached to said staple enclosure and formed with a projection having an outer end surfae and a peripheral surface; said staple enclosure projection being engageable with said push member; said actuating member also having a fin located near and extending past said projection; said fin including an edge operative to and positioned so as to engage said push member and to rock the same toward and away from said ejector lever; said fin being shaped to move said push member beyond said outer end surface of said projection when said push member has moved along said fin a first distance in one direction and is also moving past said projection end outer surface; said fin also being shaped so as to permit said push member to engage said peripheral surface of said projection on a side of said projection facing generally toward said article receiving means when said push member is moved only part of said first distance in said one direction along said fin, whereby with said push member thus in engagement with said projection peripheral surface, said staple enclosure and said ejector are biased away from said article receiving means;

biasing means urging said push member toward said fin and toward said projection and said fin being adapted to urge said push member away from said ejector lever against the force of said spring means.

15. The tagging machine of claim 1, wherein said passageway comprises strip guide means including a guide frame secured in said casing and extending from the entrance of the tag strip at said casing rear portion to said article receiving means for providing a guideway for the continuous strip of tags.

16. The tagging machine of claim 15, wherein said guide frame includes grooves in the surface thereof and positioned and shaped so as to receive said pawl means and to permit said feed pawl to be slidable back and forth in its said grooves; said guide frame further comprising a stopper slit positioned such that said stopper is moved into said passageway by passing through said stopper slit; said groove in said guide frame being of a length such that it has a foremost portion at the end thereof toward said article receiving means and said foremost portion of said groove being in the vicinity of said stopper slit; slits in said guide frame for permitting passage therethrough of said cutting blade.

17. The tagging machine of claim 1, wherein said sixth link means comprises a post on said lever, said post being spaced from said pivot mount of said lever and said said post being movable upon pivoting of said lever; said stopper being supported by a plate which extends past said post on said lever; said stopper support plate having an elongated slot formed therein which is elongated along the directions in which said stopper shifts in and out of said passageway; said post of said lever passing through said elongated slot; said elongated slot being so shaped and positioned with respect to said post of said lever that said post of said lever engages the top and bottom walls of said elongated slot only after said lever has moved a preselected distance toward its said first and said second positions, and this thereby causes the said recited motion of said stopper.

18. The tagging machine of claim 13, wherein said ejector lever is attached to said lever and said actuating member and said guide head are attached together and are pivotally attached to said casing, such that movement of said ejector lever pivots both said ejector and said actuating member with respect to said casing.

19. The tagging machine of claim 16, wherein said guide frame is further formed with a pair of J-shaped engagement portions which protrude from both sides of said guide frame; a guide plate extending substantially parallel to the upper surface of said guide frame and defining between said guide frame and said guide plate a thin way for said continuous strip of tags; a leaf spring having a rear portion away from said article receiving means and said leaf spring rear portion being secured to said guide plate and also being formed with lugs which are held in said J-shaped engagement portions.

20. A tagging machine for tagging articles, comprising:

a casing having a front portion at one end and a rear portion at its opposite end; an article receiving means at said casing one end for receiving an article to be tagged; a passageway through said casing extending toward said article receiving means for transmitting a continuous strip of tags therealong;

a lever for operating said machine and being movably mounted to said casing; said lever being movable between a first position and a second position; biasing means for normally biasing said lever to said first position;

feed means for engaging and feeding a continuous strip of tags along said passageway to said article receiving means;

a platen located in said passageway and facing toward a printing means, said platen being provided for having a tag to be printed rest thereupon; printing means facing towards said platen for printing an inscription upon a tag in a strip of tags in said passageway, which tag is the one in the strip then located on said platen; first link means linked to said lever for moving said printing means and said platen together and apart;

tag attaching means located further along said passageway toward said casing front portion than said printing means; said tag attaching means being positioned at said article receiving means and being adapted to attach together an article to be tagged and a tag then at said article receiving means; second link means linking said lever and said tag attaching means in a manner such that upon movement of said lever to one of its said positions, said tag attaching means engages the article and the tag then at said article receiving means and attaches them together, and upon movement of said lever to the other of its said positions, said tag attaching means is moved away from said receiving means and the article and the tag therein;

pressure return means engageable with said tag attaching means for forcing said tag attaching means away from said article receiving means; third link means linking said pressure return means with said lever such that said pressure return means engages said tag attaching means to force said tag attaching means away from said article receiving means upon said lever beginning to move to its said first position.

21. The tagging machine of claim 20, further comprising a pivot mount for said lever and said lever being pivotally mounted to said pivot mount; said pivot mount being located in said casing.

22. The tagging machine of claim 20, wherein said feed means includes pawl means located in and movable along said passageway and being movable toward and away from said article receiving means; said pawl means being engageable with the strip of tags upon movement of said pawl means toward said article receiving means and being desengageable from the strip of tags upon movement of said pawl means in the opposite direction; fourth link means linking said pawl means to said lever in a manner such that movement of said lever towards its said second position moves said pawl means away from said article receiving means and movement of said lever toward its said first position moves said pawl means toward said article receiving means.

23. The tagging machine of claim 22, wherein said passageway comprises strip guide means including a guide frame secured in said casing and extending from the entrance of the tag strip at said casing rear portion to said article receiving means for providing a guideway for the continuous strip of tags.

24. The tagging machine of claim 23, wherein said guide frame includes grooves in the surface thereof and positioned and shaped so as to receive said pawl means and to permit said feed pawl to be slidable back and forth in its said grooves; said guide frame further comprising a stopper slit positioned such that said stopper is moved into said passageway by passing through said stopper slit; said groove in said guide frame being of a length such that it has a foremost portion at the end thereof toward said article receiving means and said foremost portion of said groove being in the vicinity of said stopper slit; slits in said guide frame for permitting passage therethrough of a cutting blade, and a cutting blade connected to said lever in a manner such that movement of said lever to its said second position moves said cutting blade across said passageway and movement of said lever to its said first position raises said cutting blade away from said passageway and away from the strip of tags; said cutting blade being so located and movable that it moves across said passageway at a location selected to be where neighboring tags in the strip thereof will be joined.

25. The tagging machine of claim 24, wherein said guide frame is further formed with a pair of J-shaped engagement portions which protrude from both sides of said guide frame; a guide plate extending substantially parallel to the upper surface of said guide frame and defining between said guide frame and said guide plate a thin way for said continuous strip of tags; a leaf spring having a portion away from said article receiving means and said leaf spring rear portion being secured to said guide plate and also being formed with lugs which are held in said J-shaped engagement portions.

26. The tagging machine of claim 22, wherein said pawl means comprises a pawl holder; a pivot mount on said first link means for said pawl holder; a feed pawl secured to said pawl holder and engageable with the strip of tags in said passageway; means for holding said pawl continuously in engagement with the strip of tags in said passageway as said pawl means moves along said passageway.

27. The tagging machine of claim 26, wherein said feed pawl comprises pawl tips separated from each other on the opposite sides of said pawl holder and engageable with the strip of tags along the opposite side edges thereof; said pawl tips being engageable with a slit between neighboring tags of a continuous strip of tags; a pressure finger formed at a center portion of said pawl holder; means for pressing said pressure finger continuously against the surface of the strip of tags during the travel of said pawl means toward said article receiving means, thereby to prevent the strip from rising.

28. The tagging machine of claim 20, wherein said first link means is linked to said lever and to said printing means in a manner such that movement of said lever to its said second position moves said printing means against said platen to print the tag then on said platen and movement of said lever to its said first position moves said printing means off said platen.

29. The tagging machine of claim 20, wherein said tag attaching means is a stapling means for stapling the tag to the article to be tagged; said stapling means including a staple ejector and a means for pressing the ejected staple through the article and the tag; said second link means being linked to said staple ejector and said means for pressing the ejected staple in a manner such that upon movement of said lever to its said second position, said staple ejector and said means for pressing the ejected staple are in position to and are operative to press a staple through the article and the tag that is then at said article receiving means.

30. The tagging machine of claim 29, wherein said stapling means further comprises a staple holding enclosure which is pivotally connected to said casing; a guide head for said ejector; said guide head being attached to said staple enclosure at the end thereof at which said ejector is located; said guide head including a guide slot for guiding motion of said ejector;

said stapling means further comprising an ejector lever pivotally connected to said lever such that movement of said lever to its said second position moves said ejector lever to eject a staple from said staple enclosure; spring means interposed between said staple enclosure and said ejector lever for urging the same apart; said ejector being in engagement with and being guided within said guide slot of said guide head; said ejector being movable toward and away from said article receiving means; said ejector being in engagement with and being guided within said guide slot of said guide head; said ejector being movable toward and away from said article receiving means; said ejector being engageable by said ejector lever upon motion of said ejector lever toward said article receiving means, thereby to be moved by said ejector lever; said ejector being movable by being engaged by said ejector lever to separate a staple from the staples in said staple enclosure and to force the separated staple to pierce through the article and through the tag located in said article receiving means.

31. The tagging machine of claim 30, further comprising a bending member mounted to said casing in the vicinity of said article receiving means and having a surface facing toward said ejector and said staple enclosure; said bending member surface having bending grooves therein adapted for bending and clinching a staple; said ejector and said bending member grooves being so positioned that staples are moved into said bending grooves to be clinched, and said bending grooves being adaped to clinch each separated staple in the said bending grooves, thereby to complete the fastening of the printed tag to the article being tagged.

32. The tagging machine of claim 30, wherein said pressure return means includes a rockable push member which is pivotally mounted to said ejector lever so as to pivot with respect thereto, and also being mounted to be movable sideways with respect to said casing and said ejector lever toward and away from said ejector lever; said rockable push member being formed with an engagement portion; engageable means on said staple enclosure positioned to be engaged by said push member when the latter is being moved by said ejector lever away from said article receiving means, thereby causing said push member to push said staple enclosure and said ejector away from said article receiving means.

33. The tagging machine of claim 32, wherein said engageable means on said staple enclosure comprises:

an actuating member attached to said staple enclosure and formed with a projection having an outer end surface and a peripheral surface; said staple enclosure projection being engageable with said push member; said actuating member also having a fin located near and extending past said projection; said fin including an edge operative to and positioned so as to engage said push member and to rock the same toward and away from said ejector lever; said fin being shaped to move said push member beyond said outer end surface of said projection when said push member has moved along said fin a first distance in one direction and is also moving past said projection end outer surface; said fin also being shaped so as to permit said push member to engage said peripheral surface of said projection on a side of said projection facing generally toward said article receiving means when said push member is moved only part of said first distance in said one direction along said fin, whereby with said push member thus in engagement with said projection peripheral surface, said staple enclosure and said ejector are biased away from said article receiving means;

biasing means urging said push member toward said fin and toward said projection and said fin being adapted to urge said push member away from said ejector lever against the force of said spring means.

34. The tagging machine of claim 20, further comprising tag strip cutting means comprising a cutting blade for cutting the strip of tags; fourth link means linking said cutting means with said lever in a manner such that movement of said lever to its said second position moves said cutting blade across said passageway and movement of said lever to its said first position raises said cutting blade away from said passageway and away from the strip of tags; said cutting blade being so located and movable that it moves across said passageway at a location selected to be where neighboring tags in the strip thereof will be joined.

35. The tagging machine of claim 20, further comprising positioning means for a strip of tags, including a stopper movable into and out of said passageway; said stopper being shaped and oriented to be received in a slit between two adjacent tags of a strip thereof located in said passageway; positioning means link means linking said strip positioning means and said lever for moving said stopper into and out of said passageway in a sequence of operation of said stopper such that said stopper is in said passageway when said lever is in said first position and when said lever is moving to said second position, is out of said passageway when said lever has moved to said second position and returns to be in said passageway as said lever is returning from said second position to said first position.

36. A machine for tagging articles, comprising:

a casing having a front portion at one end and a rear portion at its opposite end; an article receiving means at said casing one end for receiving an article to be tagged; a passageway through said casing extending toward said article receiving means for transmitting a continuous strip of tags therealong;

a lever for operating said machine and being movably mounted to said casing; said lever being movable between a first position and a second position; biasing means for normally biasing said lever to said first position;

feed means for engaging and feeding a continuous strip of tags along said passageway to said article receiving means;

a platen located in said passageway and facing toward a printing means, said platen being provided for having a tag to be printed rest thereupon; printing means facing towards said platen for printing an inscription upon a tag in a strip of tags in said passageway, which tag is the one in the strip then located on said platen; first link means linked to said lever for moving said printing means and said platen together and apart;

tag attaching means located further along said passageway toward said casing front portion than said printing means; said tag attaching means being positioned at said article receiving means and being adapted to attach together an article to be tagged and a tag then at said article receiving means; second link means linking said lever and said tag attaching means in a manner such that upon movement of said lever to one of its said positions, said tag attaching means engages the article and the tag then at said article receiving means and attaches them together, and upon movement of said lever to the other of its said positions, said tag attaching means is moved away from said article receiving means and the article and the tag therein;

positioning means for a strip of tags, including a stopper movable into and out of said passageway; said stopper being shaped and oriented to be received in a slit between two adjacent tags of a strip thereof located in said passageway; positioning means link means linking said strip positioning means and said lever for moving said stopper into and out of said passageway in a sequence of operation of said stopper such that said stopper is in said passageway when said lever is in said first position and when said lever is moving to said second position, is out of said passageway when said lever has moved to said second position and returns to be in said passageway as said lever is returning from said second position to said first position.

37. The tagging machine of claim 36, wherein said positioning means link means comprises a post on said lever; said post being movable upon movement of said lever; said stopper being supported by a plate which extends past said post on said lever; said stopper support plate having an elongated slot formed therein which is elongated along the directions in which said stopper shifts in and out of said passageway; said post of said lever passing through said elongated slot; said elongated slot being so shaped and positioned with respect to said post of said lever that said post of said lever engages the top and bottom walls of said elongated slot only after said lever has moved a preselected distance toward its said first and said second positions, and this thereby causes the said recited motion of said stopper.

38. The tagging machine of claim 37, wherein said feed means includes pawl means located in and movable along said passageway and being movable toward and away from said article receiving means; said pawl means being engageable with the strip of tags upon movement of said pawl means toward said article receiving means and being disengageable from the strip of tags upon movement of said pawl means in the opposite direction; fourth link means linking said pawl means to said lever in a manner such that movement of said lever toward its said second position moves said pawl means away from said article receiving means and movement of said lever toward its said first position moves said pawl means toward said article receiving means.

39. The tagging machine of claim 38, wherein said passageway comprises strip guide means including a guide frame secured in said casing and extending from the entrance of the tag strip at said casing rear portion to said article receiving means for providing a guideway for the continuous strip of tags.

40. The tagging machine of claim 39, wherein said guide frame includes grooves in the surface thereof and positioned and shaped so as to receive said pawl means and to permit said feed pawl to be slidable back and forth in its said grooves; said guide frame further comprising a stopper slit positioned such that said stopper is moved into said passageway by passing through said stopper slit; said groove in said guide frame being of a length such that it has a foremost portion at the end thereof toward said article receiving means and said foremost portion of said groove being in the vicinity of said stopper slit; slits in said guide frame for permitting passage therethrough of said cutting blade.

41. The tagging machine of claim 40, wherein said guide frame is further formed with a pair of J-shaped engagement portions which protrude from both sides of said guide frame; a guide plate extending substantially parallel to the upper surface of said guide frame and defining between said guide frame and said guide plate a thin way for said continuous strip of tags; a leaf spring having a portion away from said article receiving means and said leaf spring rear portion being secured to said guide plate and also being formed with lugs which are held in said J-shaped engagement portions.

42. The tagging machine of claim 38, wherein said pawl means comprises a pawl holder; a pivot mount on said first link means for said pawl holder; a feed pawl secured to said pawl holder and engageable with the strip of tags in said passageway; means for holding said pawl continuously in engagement with the strip of tags in said passageway as said pawl means moves along said passageway.

43. The tagging machine of claim 42, wherein said feed pawl comprises pawl tips separated from each other on the opposite sides of said pawl holder and engageable with the strip of tags along the opposite side edges thereof; said pawl tips being engageable with a slit between neighboring tags of a continuous strip of tags; a pressure finger formed at a center portion of said pawl holder; means for pressing said pressue finger continuously against the surface of the strip of tags during the travel of said pawl means toward said article receiving means, thereby to prevent the strip from rising.

* * * * *